US008366159B2

(12) United States Patent
Patel

(10) Patent No.: US 8,366,159 B2
(45) Date of Patent: Feb. 5, 2013

(54) MULTI-LEVER BI-DIRECTIONAL INERTIA CATCH MECHANISM

(75) Inventor: Rajesh K Patel, Oakland, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 375 days.

(21) Appl. No.: 12/683,087

(22) Filed: Jan. 6, 2010

(65) Prior Publication Data

US 2011/0163554 A1 Jul. 7, 2011

(51) Int. Cl.

| | |
|---|---|
| ***E05B 3/00*** | (2006.01) |
| ***E05B 65/10*** | (2006.01) |
| ***E05C 3/04*** | (2006.01) |
| ***E05C 3/16*** | (2006.01) |
| ***E05C 3/12*** | (2006.01) |

(52) U.S. Cl. ..... 292/336.3; 292/92; 292/203; 292/236; 292/230

(58) Field of Classification Search ..... 292/92, 292/203, 210, 230, 236, DIG. 22, DIG. 30, 292/336.3

See application file for complete search history.

(56) References Cited

U.S. PATENT DOCUMENTS

| | | | | |
|---|---|---|---|---|
| 3,583,741 | A | 6/1971 | Breitschwerdt et al. | |
| 3,799,596 | A * | 3/1974 | Nozomu et al. | 292/216 |
| 4,536,021 | A * | 8/1985 | Mochida | 292/201 |
| 4,819,493 | A | 4/1989 | Dornan | |
| 5,669,642 | A | 9/1997 | Kang | |
| 5,725,262 | A * | 3/1998 | Kritzler | 292/336.3 |
| 5,865,481 | A * | 2/1999 | Buschmann | 292/216 |
| 6,174,005 | B1 | 1/2001 | Norton | |
| 6,382,688 | B1 | 5/2002 | Agostini | |
| 6,575,508 | B2 * | 6/2003 | Stuart et al. | 292/336.3 |
| 6,648,382 | B1 | 11/2003 | Monig et al. | |
| 7,198,307 | B2 * | 4/2007 | Drysdale et al. | 292/216 |
| 7,201,405 | B2 * | 4/2007 | Le et al. | 292/93 |
| 7,210,716 | B2 | 5/2007 | Mueller et al. | |
| 7,341,291 | B2 * | 3/2008 | Ooe et al. | 292/336.3 |
| 7,635,151 | B2 * | 12/2009 | Rodawold et al. | 292/336.3 |
| 8,029,032 | B1 * | 10/2011 | Yang | 292/336.3 |
| 8,191,953 | B2 * | 6/2012 | Simon et al. | 296/24.34 |
| 2005/0280266 | A1 | 12/2005 | Mueller et al. | |
| 2006/0038418 | A1 | 2/2006 | Huizenga et al. | |
| 2007/0120382 | A1 * | 5/2007 | Chevalier | 292/336.3 |
| 2008/0036219 | A1 * | 2/2008 | Savant et al. | 292/336.3 |

* cited by examiner

*Primary Examiner* — Thomas Beach
*Assistant Examiner* — Nathan Cumar
(74) *Attorney, Agent, or Firm* — Raymond L. Coppiellie; Price Heneveld LLP

(57) ABSTRACT

An inertia blocking mechanism operably connected to a door handle on a vehicle having a handle chassis. A counterweight is operably connected to the handle chassis and is pivotally rotatable about a first pivot axis between a non-actuated position and an actuated position. Stanchions extends from the handle chassis. A spring-biased primary inertia lever is operably connected with the stanchions and is pivotally rotatable about a second pivot axis. The spring-biased primary inertia lever is biased to a first position out of rotational alignment with the counterweight. An auxiliary inertia lever is pivotally rotatable about the second pivot axis and is adapted to move the primary inertia lever into a second position in rotational alignment with the counterweight, which prevents the counterweight from rotating downward into the actuated position, thereby actuating the exterior door handle thereby preventing the exterior handle from actuating and releasing the latch.

19 Claims, 5 Drawing Sheets

MULTI-LEVER BI-DIRECTIONAL INERTIA CATCH MECHANISM

FIELD OF THE INVENTION

The present invention generally relates to a multi-lever bi-directional inertia catch mechanism.

BACKGROUND OF THE PRESENT INVENTION

Inertia catch mechanisms are frequently used in vehicles to prevent accidental opening of a vehicle door during a collision event.

SUMMARY OF THE PRESENT INVENTION

One aspect of the present invention includes an inertia blocking mechanism operably connected to a door handle on a vehicle having a handle chassis. A counterweight is operably connected to the handle chassis and is pivotally rotatable about a first pivot axis between a non-actuated position and an actuated position. Stanchions extend from the handle chassis. A spring-biased primary inertia lever is operably connected with the stanchions and is pivotally rotatable about a second pivot axis. The spring-biased primary inertia lever is biased to a first position out of rotational alignment with the counterweight. An auxiliary inertia lever is adjacent to the primary inertia lever and is operably connected with the stanchions. The auxiliary inertia lever is pivotally rotatable about the second pivot axis and is adapted to move the primary inertia lever into a second position in rotational alignment with the counterweight, which prevents the counterweight from rotating downward into the actuated position, thereby preventing actuation of the exterior door handle.

Another aspect of the present invention includes an inertia blocking mechanism having a counterweight operably connected to a handle chassis and includes a first rotational path of travel. A primary inertia lever is proximate the counterweight and includes a second rotational path of travel that intersects the first rotational path of travel. An auxiliary inertia lever is proximate the primary inertia lever. The auxiliary inertia lever is rotatable about the second rotational path of travel and adapted to abut the primary inertia lever.

Yet another aspect of the present invention includes a method of making an inertia blocking mechanism for a door of a vehicle to keep the door from opening during a collision. A counterweight is rotatably connected with a door chassis fixedly attached with the vehicle door. The counterweight includes a path of travel about a first pivot axis between an actuated position and a non-actuated position. A primary inertia lever is rotatably connected with the door chassis. The primary inertia lever rotates about a second pivot axis between an interference position in the path of travel of the counterweight and a non-interference position out of the path of travel of the counterweight. An auxiliary inertia lever is rotatably connected with the door chassis. The auxiliary inertia lever rotates around the second pivot axis between a home position and an operative position. An outboard acceleration is applied to the vehicle, which causes the auxiliary inertia lever to abut and apply force to the primary inertia lever and rotate from the home position to the operative position and rotate the primary inertia lever from the non-interference position to the interference position into the path of travel of the counterweight, thereby preventing the counterweight from rotating from the non-actuated position into the actuated position. An inboard acceleration is applied to the vehicle, which causes the auxiliary inertia lever to disengage the primary inertia lever and rotate back to the home position, while the primary inertia lever stays in the interference position.

These and other aspects, objects, and features of the present invention will be understood and appreciated by those skilled in the art upon studying the following specification, claims, and appended drawings.

DETAILED DESCRIPTION OF EMBODIMENTS

Figures 1, 1A:
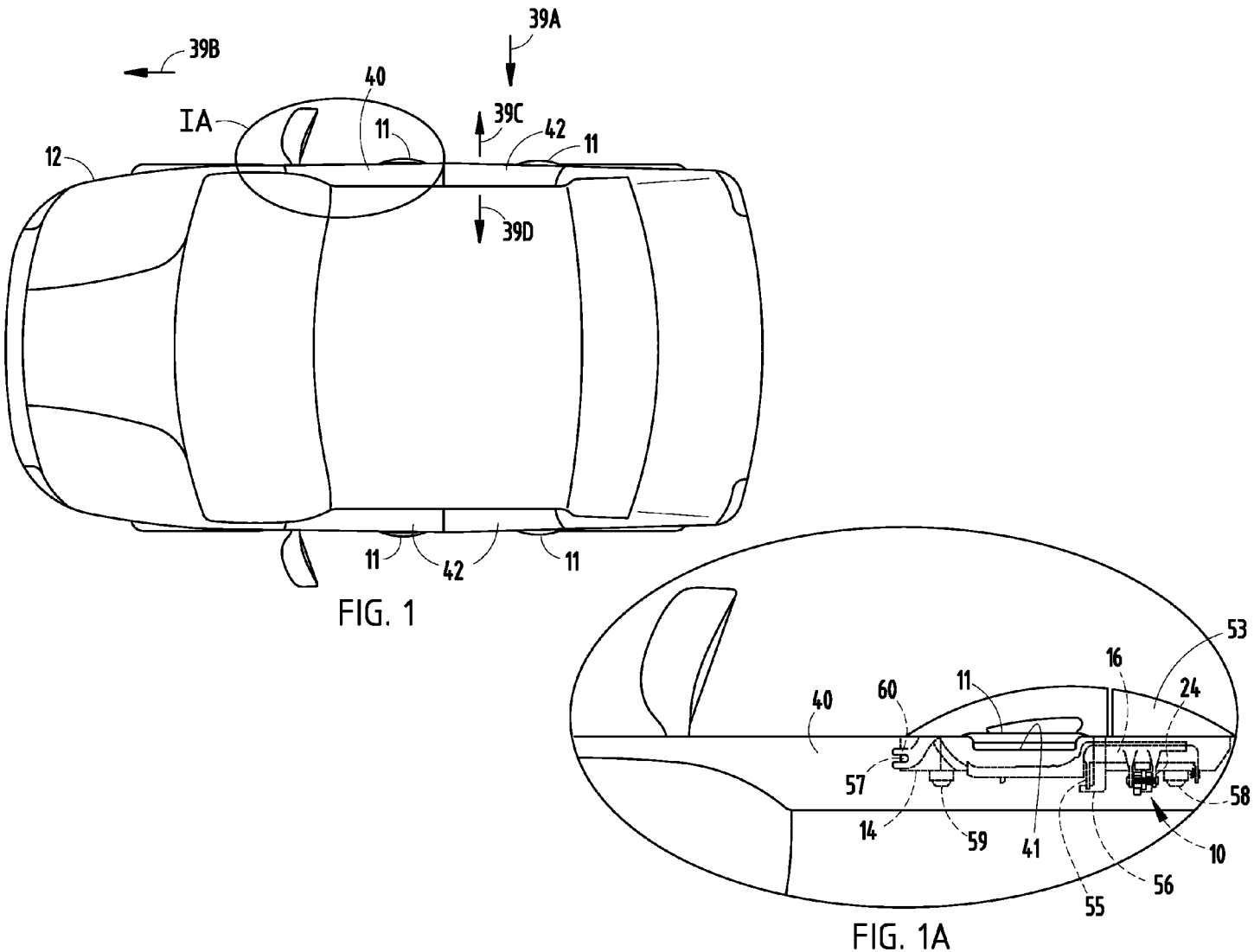
FIG. 1 is a top plan view of a vehicle incorporating one embodiment of an inertia blocking mechanism of the present invention.
FIG. 1A is an enlarged top plan view of area IA of FIG. 1.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4B:
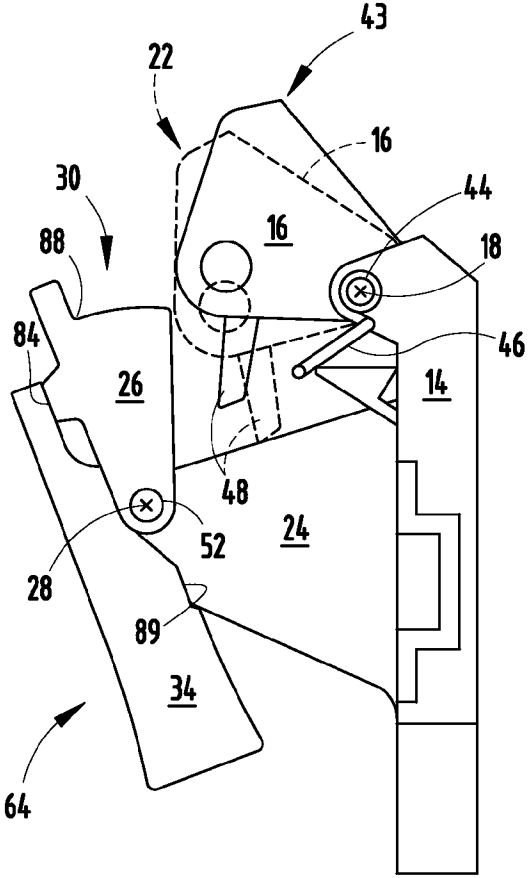
FIG. 4B is the inertia blocking mechanism of FIG. 4A with the counterweight in the actuated position.
Figure 4A:
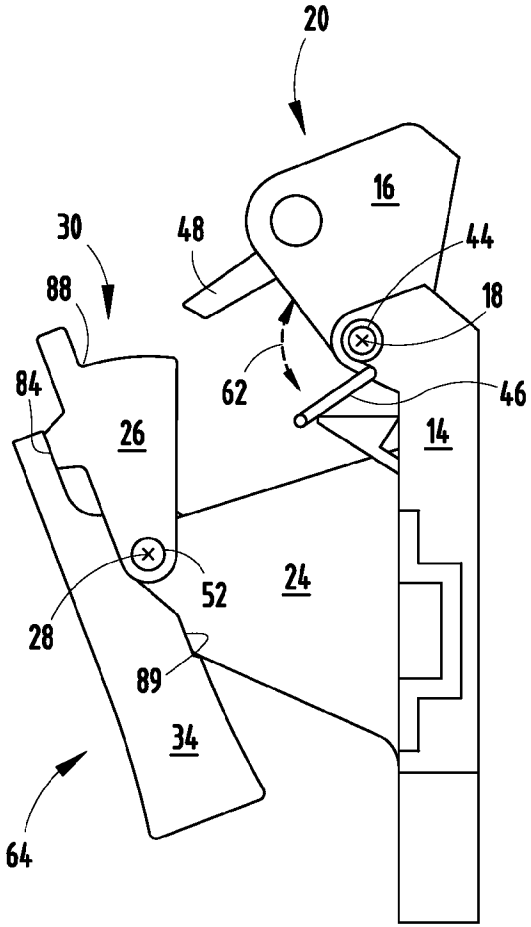
FIG. 4A is a rear elevational view of one embodiment of an inertia blocking mechanism of the present invention with the counterweight in the non-actuated position.

Referring to FIGS. 1, 1A, and 4A, the reference numeral 10 generally designates an inertia blocking mechanism operably connected to a door handle 11 on a vehicle 12 having a handle chassis 14. A counterweight 16 is operably connected to the handle chassis 14 and is pivotally rotatable about a first pivot axis 18 between a non-actuated position 20 and an actuated position 22. Stanchions 24 extend from the handle chassis 14. A spring-biased primary inertia lever 26 is operably connected with the stanchions 24 and is pivotally rotatable about a second pivot axis 28. The spring-biased primary inertia lever 26 is biased to a first position 30 out of rotational alignment with the counterweight 16. An auxiliary inertia lever 34 is adjacent to the primary inertia lever 26 and is operably connected with the stanchions 24. The auxiliary inertia lever 34 is pivotally rotatable about the second pivot axis 28 and is adapted to move the primary inertia lever 26 into a second position 36 in rotational alignment with the counterweight 16, which prevents the counterweight 16 from rotating downward into the actuated position 20, thereby actuating the exterior door handle 11.

A typical side impact collision involves an impacting vehicle moving at a given velocity in the direction or arrow 39A and an impact vehicle 21 that is either moving or stationary. When the impacting vehicle strikes the impacted vehicle 12, the handle 11 initially (around 5-8 milliseconds) experiences an outboard acceleration in the direction of arrow 39C generated by the outward bulge in the outer panel. The acceleration then reverses from the outboard direction 39C to an inboard direction 39D after the initial impact, thereby generating a bi-directional acceleration pulse.

Referring again to FIGS. 1 and 1A, the inertia blocking mechanism 10 is shown disposed in a passenger side door 40 of the vehicle 12. However, it is contemplated that the inertia blocking mechanism 10 may be installed in all vehicle doors 42, with doors 42 on an opposite of the vehicle 12 having a mirror image construction of the inertia blocking mechanism 10 than that shown on the passenger side door 40 of the vehicle 12. The inertia blocking mechanism 10 is shown in FIG. 1A adjacent to the external door handle 11 and a handle cavity 41. It is contemplated that the inertia blocking mechanism 10 can be disposed anywhere in the door 40.

Figure 2:
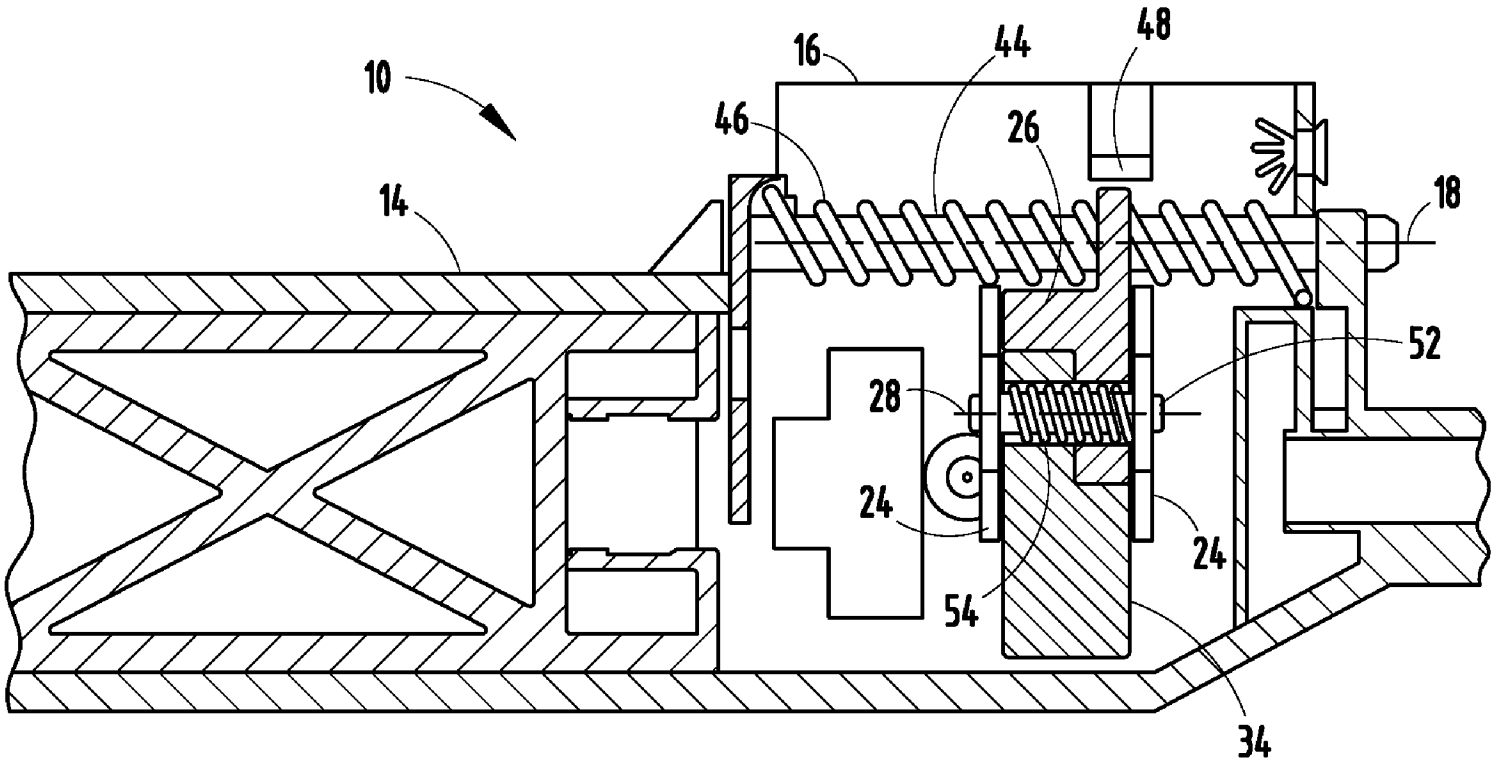
FIG. 2 is a side elevational view of one embodiment of the inertia blocking mechanism of the present invention.

Referring now to FIG. 2, the handle chassis 14 supports the inertia blocking mechanism 10 inside the vehicle door 40. The counterweight 16 is rotatable about the first pivot axis 18 on a first pivot pin 44. A torsion spring 46 extends around the first pivot pin 44 and biases the counterweight 16 to the non-actuated position 20. In the embodiment illustrated, the counterweight 16 is in the non-actuated position 20 when the counterweight 16 is in a raised position. The counterweight 16 includes an elongated engagement member 48 that extends from the counterweight 16. The counterweight 16 also includes a hook 55 that bottoms out against the chassis of the vehicle 12 when the counterweight 16 is in the actuated position 22. In the embodiment illustrated, the actuated position 22 is when the counterweight 16 is rotated into a lowered position about the first pivot pin 44. The primary inertia lever 26 and auxiliary inertia lever 34 pivot about the second pivot axis 28 on a second pivot pin 52. The second pivot pin 52 includes a torsion spring 54 that encircles the second pivot pin 52 and biases the primary inertia lever 26 into the first non-interference position 30.

Figure 3:
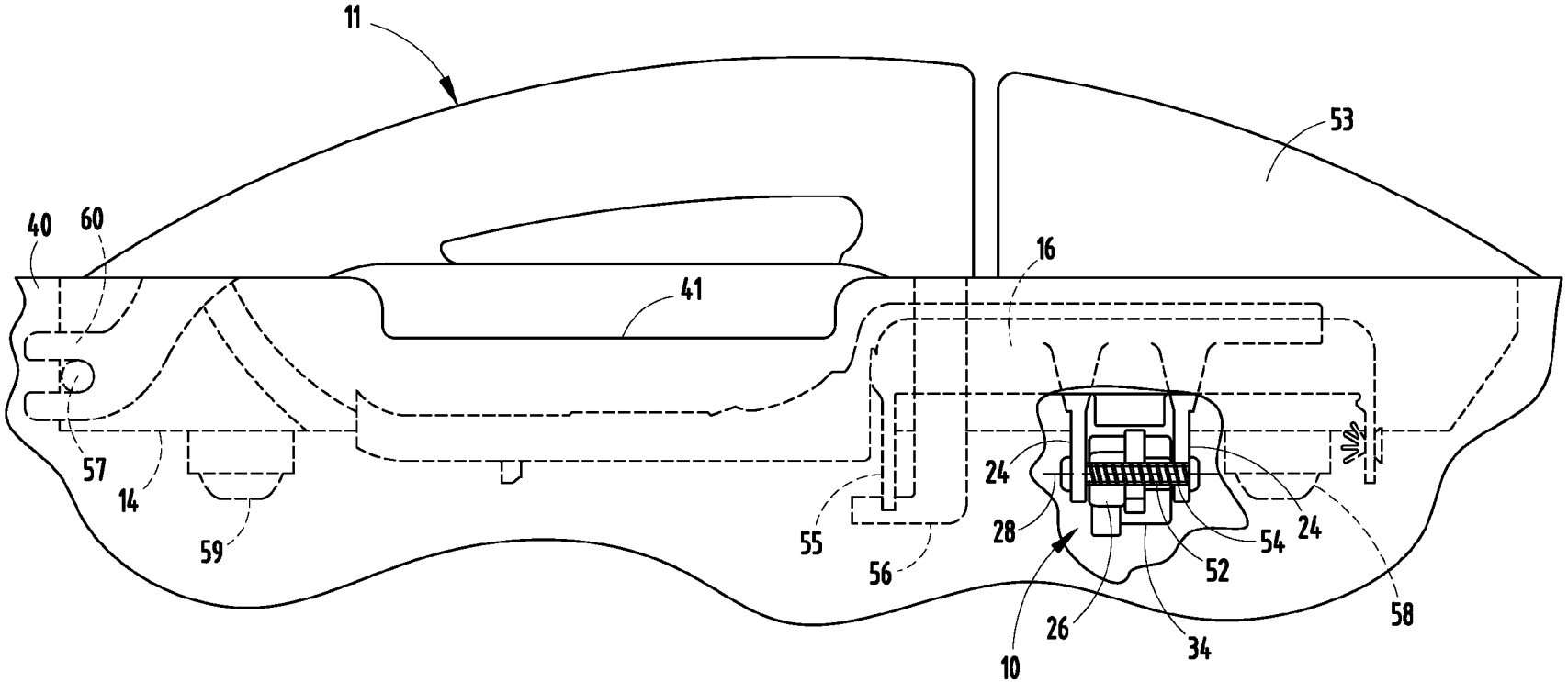
FIG. 3 is a top plan view of the inertia blocking mechanism of the present invention.

Referring now to the illustrated embodiment of FIG. 3, the handle 11 is disposed adjacent to a fixed bezel 53 that provides an aesthetic appearance and a seemingly smooth continuity of the handle 11 on the exterior of the vehicle door 40. A rear portion of the handle 11 includes a handle rear hook or plunger 56 that extends into the vehicle door 40. A forward portion of the handle 11 includes a handle forward hook 60 that is pivotally engaged with a handle pivot 57. The handle pivot 57 is integral with the handle chassis 14 and, together with the handle forward hook 60, allows slight rotation of the door handle 11 when the vehicle door 40 is being opened. The handle chassis 14 is connected to the door by way of a rear attachment fastener 58 and a forward attachment fastener 59.

Referring to FIGS. 4A and 4B, the illustrated embodiment depicts the primary inertia lever 26 in the non-interference position 30 (FIG. 4A). When the primary inertia lever 26 is in the non-interference position 30, the counterweight 16 is rotatable against the spring bias of the torsion spring 46 to rotate downward into the actuated position 22 (FIG. 4B). The counterweight 16 will rotate into the downward actuated position 22 when a user engages the exterior door handle 11 and attempts to open the door 40. When a user attempts to open the door 40, the counterweight 16 moves into a release position 43, thus releasing a door latch (not shown), thereby allowing the vehicle door 40 to open. In the illustrated embodiment, the counterweight 16 rotates downward in the direction of arrow 62 into the actuated position 22. Accordingly, the counterweight 16 has a path of travel between the non-actuated position 20 and the actuated position 22. It should be noted that the primary inertia lever 26 maintains the non-interference position 30 and the auxiliary inertia lever 34 maintains a home position 64 during normal use of the door handle 11 of the vehicle 12.

Figure 4E:
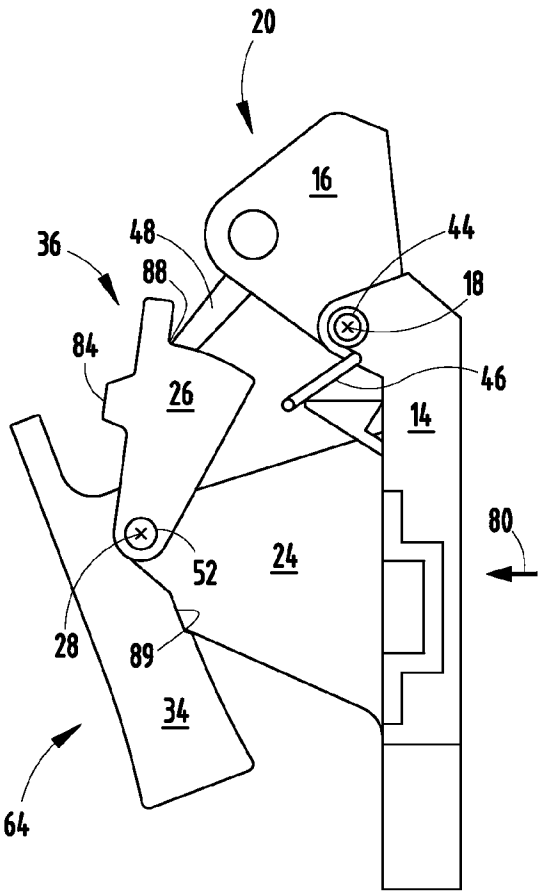
FIG. 4E is a rear elevational view of the inertia blocking mechanism of FIG. 4A during an inboard acceleration.
Figure 4D:
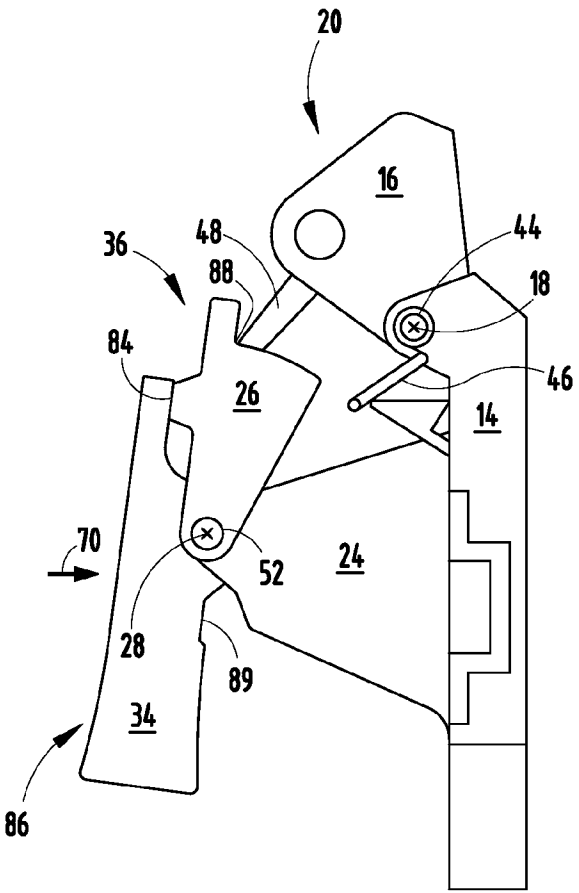
FIG. 4D is a rear elevational view of the inertia blocking mechanism of FIG. 4A at the end of a collision event, at the end of the outboard acceleration.
Figure 4C:
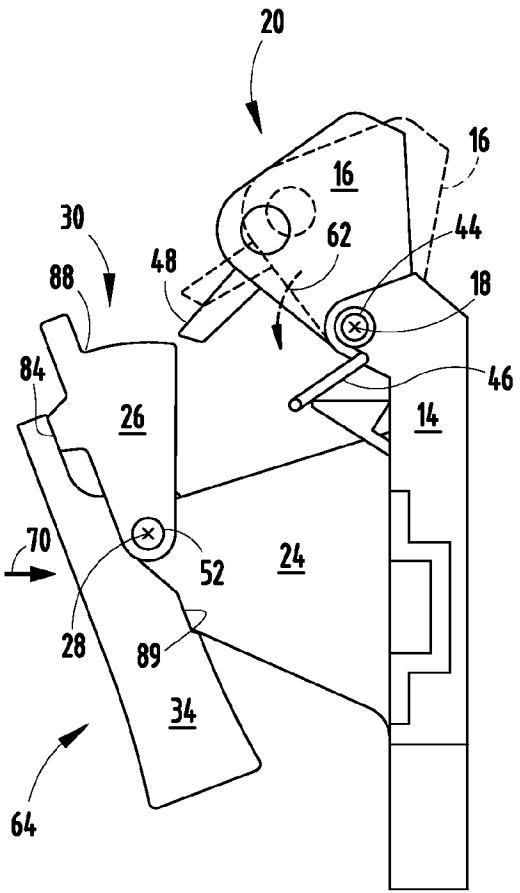
FIG. 4C is the inertia blocking mechanism of FIG. 4A at the beginning of a collision event during an outboard acceleration.

Referring to FIGS. 4C-4E, during a side impact collision event between and impacting vehicle and an impacted vehicle, the first effect measured at the outside door handle 11 is that the outer door panel bulges outward similar to a sail under the influence of a gust of wind or a blanket on a beach under the influence of a sudden gust of wind. The outboard acceleration lasts for approx 7-8 ms depending on the crash mode and then as the impacting vehicle begins to intrude into the impacted vehicle, the acceleration reverses from outboard to inboard. Peak accelerations during the outboard acceleration event could be as high as 200-250 Gs (1 G=9.8 m/s$^2$. Peak accelerations during the inboard acceleration event can be as high as 550 to 600 Gs. The reaction (Force) to the acceleration is based on Newton's second law Force=mass multiplied by acceleration. The reaction will be in opposite direction to the direction of the acceleration per Newton's Third Law (every action has equal and opposite reaction). The mass of the primary and auxiliary inertia levers are designed to react rapidly by rotating into the blocking zone, which intersects the travel path of the counter mass. The mass of the inertia levers 26 and 34 react to the inboard and outboard accelerations, respectively, and actuate to block the counter weight 16 very rapidly because of the high input acceleration.

Referring again to FIGS. 4C and 4D, during a side impact collision event, in the direction of the arrow 70, the counterweight 16 is urged downward into the actuated position 22. A collision event can exert enough force in the direction of arrow 70 to move the counterweight 16 past the release position 43, which can release the door latch (not shown) and open the door 40. To counter this undesirable consequence during a collision event, the primary inertia lever 26 and auxiliary inertia lever 34 are installed to prevent the counterweight 16 from entering the actuated position 22. The primary inertia lever 26 has a center of gravity above the second pivot axis 28 and the auxiliary inertia lever 34 has a center of gravity below the second pivot axis 28. A collision event causes a force in the direction of arrow 70 (which is generated due to the initial outboard acceleration experienced by the handle during the side collision event) to be applied to the vehicle 12, and the force can be sufficient enough to force the counterweight 16 against the spring bias of a spring 46. The same force generates a reaction force in the opposite direction to the arrow 70, which in turn rotates the auxiliary inertia lever 34 in a counterclockwise direction until the auxiliary inertia lever 34 contacts the primary inertia lever 26 at stop 82. Once the contact occurs, the primary inertia lever 26 and auxiliary inertia lever 34 act together to rotate the about second pivot axis 28. The auxiliary inertia lever 34 rotates from the home position 64 about second pivot axis 28 and engages an auxiliary stop 84 on the primary inertia lever 26. The primary inertia lever 26 rotates about the second pivot axis 28 as a result of its own leverage on the stanchions 24 and as a result of the applied force of the auxiliary inertia lever 34. As a result of the additional force by the auxiliary inertia lever 34, the primary inertia lever 26 can move into the interference position 36 faster than the primary inertia lever 26 acting alone. The auxiliary inertia lever 34 continues to rotate until the auxiliary inertia lever 34 reaches an operative position 86. The primary inertia lever 26 continues to rotate until it is in the interference position 36. When the primary inertia lever 26 is in the interference position 36, the elongated engagement member 48 of the counterweight 16 engages the primary inertia lever 26 and abuts a counterbalance stop 88 on the primary inertia lever 26. Accordingly, the counterweight 16 has been prevented from entering the actuated position 22 effectively.

Once the motion of the counterweight 16 is interrupted by lever 26 under the influence or push of lever 34 during the outboard acceleration, the counterweight 16 returns to the home position (after being blocked or interrupted by lever 26) until an inboard acceleration in the direction of arrow 80 occurs. The handle 11 now moves towards release, but because the handle 11 is connected to the counterweight 16 via hook 55, the counterweight 16 once again starts to actuate, but the inertia lever 26 is already in the interference position 36 from the previous outboard acceleration, and thus, the counterweight cannot actuate, even during the inboard acceleration.

More specifically, referring again to FIG. 4E, after the outboard acceleration from the initial collision event has dissipated, the inboard acceleration in the direction of arrow 80 occurs. The inboard acceleration generates a reaction force in the opposite direction to arrow 80 and pushes the auxiliary lever 34 away from the primary lever 26. As a result of the inboard acceleration, the primary inertia lever 26 continues to maintain the interference position 36. Because the center of gravity of the auxiliary inertia lever 34 is below the second pivot axis 28, the auxiliary inertia lever 34 is forced to rotate back to the home position 64 and comes to rest when a stanchion stop 89 on the auxiliary inertia lever 34 abuts at least one of the stanchions 24. Similarly, the center of gravity of the primary inertia lever 26 is above the pivot axis 28 and consequently the reaction force opposite to the direction of arrow 80 keeps the primary inertia lever 26 in the interference position 36. Consequently, as shown in FIG. 4E, the counterweight 16 maintains the non-actuated position 22 because the primary inertia lever 26 maintains the interference position 36. Therefore, the counterweight 16 is prohibited from engaging the actuated position 22 during both the initial outboard acceleration in the direction of arrow 70 and the subsequent inboard acceleration in the direct of arrow 80.

As explained above, the primary inertia lever 26 and auxiliary inertia lever 34 of the inertia blocking mechanism 10 rotate about the second pivot axis 28, which extends horizontally and which is parallel to the first pivot axis 18 about which the counterweight 16 rotates. The force of gravity acts in a downward direction on both the first and second pivot axes 18, 28. Inertia catch mechanisms that include horizontally rotating levers with an axis of rotation perpendicular to the axis of rotation of counterweight 16, will have a deflection as a result of the force of gravity on the lever. The deflection could cause the lever to miss the blocking area of the counter weight 16. The inertia blocking mechanism disclosed above substantially eliminates any cantilevered deflection that might otherwise be present with an inertia blocking device that having a lever that rotates vertically (perpendicular) to the axis of rotation of the counterweight.

Additionally, during a side impact collision event, the counter weight 16 (which can be a factor of 10-15 times the mass of the primary inertia lever 26) rotates downwardly with a very high impact force and collides with the primary inertia lever 26. Inertia catch devices with levers that include a horizontally rotating lever (that pivot about a vertical axis), can deflect downward under this massive impact force which can generate an oscillation up or down during the rebound of the lever.

Furthermore, in the present invention, the primary inertia lever 26 and the auxiliary inertia lever 34 rotate about a horizontal axis and therefore the impact force of the counter weight 16 during a side impact collision event is received by the second pivot pin 52 pin about which the two levers 26, 34 rotate. Therefore, there is no downward deflection from the force of gravity, as could occur in a horizontally rotating lever, and also no deflection due to the impact force from the counter weight 16. Because there is no deflection, the primary inertia lever 26 behaves rigidly and swings downward accurately and consistently before stopping in the blocking zone. The lack of deflection due to gravity as can occasionally occur in some horizontally cantilevered blocking mechanisms as well as the lack of vertical wobble and oscillation after impact makes this inertia lever system solution very accurate, fast and robust.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. An inertia blocking mechanism operably connected to a door handle on a vehicle, comprising:

a handle chassis;

a counterweight operably connected to the handle chassis and pivotally rotatable about a first pivot axis between a non-actuated position and an actuated position;

stanchions extending from the handle chassis;

a spring-biased primary inertia lever operably connected with the stanchions and pivotally rotatable about a second pivot axis between an interference position and a non-interference position, the spring-biased primary inertia lever being biased to the non-interference position out of rotational alignment with the counterweight; and an auxiliary inertia lever adjacent to the primary inertia lever and operably connected with the stanchions, wherein the auxiliary inertia lever is pivotally rotatable about the second pivot axis while the primary inertia lever maintains the interference position, and is adapted to move the primary inertia lever into the second position in rotational alignment with the counterweight, which prevents the counterweight from rotating downward into the actuated position, thereby preventing actuation of the exterior door handle.

2. The inertia blocking mechanism of claim 1, wherein the primary inertia lever is spring-biased to a position out of rotational alignment with the counterweight.

3. The inertia blocking mechanism of claim 1, wherein the primary inertia lever includes an auxiliary stop.

4. The inertia blocking mechanism of claim 1, wherein the primary inertia lever includes a counterbalance stop.

5. The inertia blocking mechanism of claim 1, wherein the auxiliary inertia lever includes a stanchion stop.

6. The inertia blocking mechanism of claim 1, wherein the counterweight is spring-biased to the non-actuated position by a torsion spring.

7. An inertia blocking mechanism, comprising:

a counterweight operably connected to a handle chassis and having a first rotational path of travel;

a primary inertia lever proximate the counterweight and having a second rotational path of travel that intersects the first rotational path of travel; and an auxiliary inertia lever proximate to and independently rotatable relative to the primary inertia lever about the second rotational path of travel, and adapted to abut the primary inertia lever.

8. The inertia blocking mechanism of claim 7, wherein the primary inertia lever is spring-biased to a position out of the path of travel of the counterweight.

9. The inertia blocking mechanism of claim 8, wherein the primary inertia lever includes an auxiliary stop adapted to interface with the auxiliary inertia lever.

10. The inertia blocking mechanism of claim 9, wherein the primary inertia lever includes a counterbalance stop adapted to interface with the counterweight.

11. The inertia blocking mechanism of claim 10, wherein the auxiliary inertia lever includes a stanchion stop.

12. The inertia blocking mechanism of claim 11, wherein the counterweight is spring-biased to a raised position by a torsion spring.

13. A method of making an inertia blocking mechanism for a door of a vehicle to keep the door from opening during a collision, the method comprising:

rotatably connecting a counterweight with a door chassis fixedly attached with the vehicle door, wherein the counterweight includes a path of travel about a first pivot axis between an actuated position and a non-actuated position;

rotatably connecting a primary inertia lever with the door chassis, wherein the primary inertia lever rotates about a second pivot axis between an interference position in the path of travel of the counterweight and a non-interference position out of the path of travel of the counterweight;

rotatably connecting an auxiliary inertia lever with the door chassis, wherein the auxiliary inertia lever independently rotates around the second pivot axis between a home position and an operative position, and wherein an outboard acceleration applied to the vehicle causes the auxiliary inertia lever to abut and apply force to the primary inertia lever and rotate from the home position to the operative position and rotate the primary inertia lever from the non-interference position to the interference position into the path of travel of the counterweight, thereby preventing the counterweight from rotating from the non-actuated position into the actuated position, and wherein an inboard acceleration applied to the vehicle causes the auxiliary inertia lever to disengage the primary inertia lever and rotate back to the home position, while the primary inertia lever stays in the interference position.

14. The method of claim 13, further comprising:

connecting a spring with the primary inertia lever that biases the primary inertia lever to the non-interference position out of the path of travel with the counterweight.

15. The method of claim 13, further comprising:

positioning the center of gravity of the auxiliary inertia lever below the second pivot axis and the center of gravity of the primary inertia lever above the second pivot axis.

16. The method of claim 13, further comprising:

extending a counterbalance stop from the primary inertia lever that is adapted to abut the counterweight.

17. The method of claim 13, further comprising:

extending an elongated engagement member from the counterweight.

18. The method of claim 13, further comprising:

rotatably connecting the primary inertia lever and auxiliary inertia lever to stanchions.

19. The method of claim 13, wherein the counterweight is spring-biased to a raised position and an inertia cable extends from the counterweight.

* * * * *